United States Patent [19]

Wheeler

[11] 4,305,233

[45] Dec. 15, 1981

[54] HONING DEVICE AND METHOD OF USE

[76] Inventor: Raymond R. Wheeler, 39, Nixon St., Hamilton, New Zealand

[21] Appl. No.: 956,460

[22] Filed: Oct. 31, 1978

[51] Int. Cl.[3] ..... B24D 15/10

[52] U.S. Cl. ..... 51/210; 51/214; 51/285

[58] Field of Search ..... 51/125, 125.5, 131.1, 51/210, 211 R, 211 H, 214, 285; 76/85, 89, DIG. 9

[56] References Cited

U.S. PATENT DOCUMENTS

| | | | |
|---|---|---|---|
| 2,099,179 | 11/1937 | Stainbrook | 51/131.1 |
| 2,498,018 | 2/1950 | Thompson | 51/210 |
| 2,920,426 | 1/1960 | Williams | 51/214 X |
| 2,953,851 | 9/1960 | Wheeler | 30/35 |
| 3,163,964 | 1/1965 | Wheeler | 51/125 |

FOREIGN PATENT DOCUMENTS

| | | | |
|---|---|---|---|
| 38976 | 6/1928 | Denmark | 51/210 |

*Primary Examiner*—Gary L. Smith

*Attorney, Agent, or Firm*—William A. Drucker

[57] ABSTRACT

A device, for honing the axially-facing cutting edges of a rotary shaver cutter, has two parts which are rotatable one with respect to the other. Within one part there is disposed a frictional element abutted by the cutter so as to prevent relative rotation between the cutter and that part. The other part carries an abrasive abutted by the cutting edges of the cutter. At one end, the device has a first recess, on one part, which receives a finger or thumb tip, or an end of a holder, and is smooth for easy relative rotation. At the opposite axial end, the device has a second recess, on the other part, which receives a thumb or finger tip, or another end of the holder, and is formed to prevent relative rotation. The outer part has a circumferential surface adapted for frictional engagement with a running surface such as a table top. With the device held between finger and thumb, or between the ends of the holder held in the hand, running it backwards and forwards in contact with the running surface causes the cutter edges to be honed.

12 Claims, 3 Drawing Figures

HONING DEVICE AND METHOD OF USE

BACKGROUND OF THE INVENTION

There are numerous rotary electric shavers, such as for example those marketed by PHILIPS, which utilize a rotary cutter head having a plurality of axially-facing cutting edges. These cutting edges become blunted during long and continual use in shaving, and it is desirable to be able to hone them into a state of adequate sharpness, thereby avoiding cost of unnecessary and too frequent replacement, and avoiding the shaver being out of action for long periods.

OBJECT OF THE INVENTION

It is accordingly the object of the invention to provide a simple and robust device in which a rotary cutter head can be inserted, whereafter the device is grasped between finger and thumb, or between portions of a holder, and run along in frictional contact with any convenient running surface such as a table top, causing relative rotation between the cutter head and an abrasive surface in the device for honing the cutting edges.

SUMMARY OF THE INVENTION

According to the present invention, a device, for honing a shaver rotary cutter head having axially-facing cutting edges, comprises first and second members journalled one with respect to the other for relative rotation about an axis, one of said members having at a first exposed axial end a formation adapted for non-rotatable engagement by a first digit of a user holding the device between two opposed digits, the other of said members having at a second exposed axial end remote from said first end means such as a formation adapted to journal said other member by engagement with the other of said digits for rotation substantially about said axis, means to act between one of said members and a rotary cutter head disposed when the device is in use coaxially intermediate said respective exposed axial ends for preventing relative rotation of said cutter head with respect to said one member, and an abrasive face on the other of said members for contacting the axially-facing cutting edges of said cutter head, said other member having an external circumferential surface adapted for frictional engagement with a running surface.

One of said first and second members may conveniently be tubular, and the other of said first and second members rotatable within said one member, the tubular member having one end open and the other end at least partially closed by an end wall provided with said formation adapted to journal the member on the other digit of the user.

The formation adapted to journal the member on the other digit of the user may be an axial recess bounded by a smooth surface and the formation at the first exposed axial end of said one member, adapted for non-rotatable engagement by a first digit of the user, may be an axial recess coaxial with said axis and bounded by a surface having angularly spaced projections.

The means to act between one of said members and the rotary cutter head, for preventing relative rotation of the cutter head with respect to said one member, is preferably an element of elastomeric material adapted to bear frictionally on said cutter head, e.g. a ring seated loosely in said one member.

The abrasive surface may be on an abrasive element positioned against said other member for contacting the axially-facing cutting edges of the cutter head.

For frictional engagement with the running surface, the other member carries an external circumferential sleeve having said said external circumferential surface.

In a preferred embodiment, the device comprises a first member which is tubular, a second member positioned in said first member and journalled therein for relative rotation about an axis, said tubular member having one end open and the other end at least partially closed by an end wall having at its axially exposed face a frusto-conical axial recess coaxial with said axis and bounded by a smooth surface, said recess being adapted to receive the tip of a digit of the user such that said first member is journalled on said digit, said second member having at the oposite axial exposed end a frusto-conical axial recess bounded by a surface having angularly spaced radial ribs adapted to engage the tip of a second digit of the user to prevent rotation of said member relative to said second digit, a ring of elastomeric material disposed within said first member and seated against said end wall, an annulus of abrasive material secured coaxially on said second member remote from said axial recess, such that a rotary cutter head may be positioned between said elastomeric ring and said abrasive annulus, and a sleeve of elastomeric material secured coaxially about said first member and having its external circumferential surface adapted for frictional engagement with the running surface.

A method of use of the device includes the steps of:

(i) disposing said rotary cutter in the device coaxially with respect to said first and second members and contacting said means for preventing relative rotation and with its cutting edges abutting said abrasive face;

(ii) grasping the device between a first and a second digit, the first digit engaging said formation for non-rotatable engagement, the second digit engaging said formation for rotation;

(iii) placing said external circumferential surface in frictional engagement with a running surface, and (iv) moving the device along said running surface in at least one direction with said external circumferential surface maintained in frictional engagement with said running surface.

DESCRIPTION OF THE PREFERRED EMBODIMENT

Figure 1:
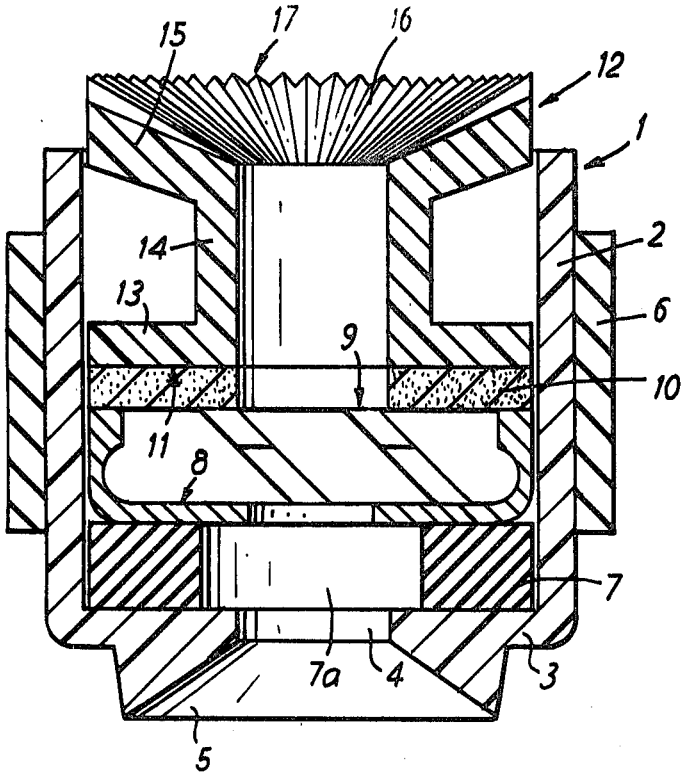
FIG. 1 is an axial section of a preferred embodiment of honing device in accordance with the invention.

The honing device comprises a tubular body portion 1 having a cylindrical side wall 2. One end of the body is open, and the other end is partially closed by an annular end wall 3 bounding an opening 4. Coaxial with the opening 4, the end wall 3 has a frusto-conical recessed surface 5 which is made smooth for a purpose to be explained hereinafter. The body 1 is conveniently manufactured as an integral whole of relatively stiff plastics material, e.g. by injection molding.

On the outside of the side wall 2 of the body 1 there is secured a friction sleeve 6 made, for example, of rubber or other elastomeric tubing. The sleeve 6 may conveniently be retained in position on the body 1 by the inherent resilience of the sleeve, which is fitted to the body 1 by stretching the sleeve radially and slipping it over the body 1.

Within the body 1, at the lower end thereof as illustrated in this drawing, there is provided a friction ring 7. This ring may either seat loosely against the inside face of the end wall 3 of the body, or may be coupled thereto, e.g. bonded or cemented thereto.

On top of the friction ring 7 there is seated the conventional rotary cutter head 8 of a rotary-type electric razor, for example a typical cutter of the rotary shavers currently marketed in the United States by PHILIPS. The cutter head 8 is disposed with its cutter edges 9 upwardly facing. On top of the cutter head 8, and contacting its plural cutter edges 9 there is disposed an annulus 10 of abrasive material coupled, as by bonding or cementing for example, to the underface 11 of a spool member 12. The spool shape is preferred for providing stability within the body 1. The spool member has a lower radial flange 13 on which the annulus 10 is mounted, a tubular central portion 14, and an upper radial flange 15. The upper end face 16 of the flange 15 is frusto-conical, and is provided with a radial rib formation 17. The cutter head 8, the abrasive annulus 10 and the spool member 12 are all fitted with radial clearance within the side wall 2 of the body, so as to be freely rotatable with respect to the body 1. The operation of the device is as follows:

With the various elements assembled as shown, the device is grasped between the forefinger and thumb of one hand of the user, one digit being pressed at its tip into the frusto-conical recessed surface 5 of the body 1, and the other digit being pressed at its tip into the frusto-conical recessed ribbed surface 16 of the spool 12.

The device is then run along any convenient flat surface, such as a table top, shelf, or the like, with the sleeve 6 contacting the flat surface and frictionally rotated by such rubbing contact. The body 1 rotates with the sleeve 6 and there is slipping movement between the smooth surface 5 and the finger or thumb pressed therein. The spool 12 is prevented from rotation relative to the finger or thumb pressed into the surface 16, by reason of the ribbing 17. The friction ring 7 bears frictionally against the end wall 3 of the body 1, and therefore rotates with the body 1. The cutter head 8 bears frictionally against the friction ring 7, and therefore rotates with the friction ring 7 and with the body 1. The abrasive annulus 10 is secured to the spool member 12 and therefore remains stationary, with the spool member. Accordingly, there is relative rotation between the underface of the abrasive annulus 10 and the cutter edges 9 of the cutter head 10, which serves to hone the cutter edges. The device may conveniently be run backwards and forwards along the same flat surface so that relative rotation is obtained alternately in each direction between the abrasive ring and the cutter edges. It will be appreciated that another relatively rotatable digit-contact member could be journalled on the body 1 to replace the smooth recess 5.

Some of the conventional cutter heads 8 include a hub which extends axially at the end of the cutter head remote from the cutter edges 9, and such a hub can be accommodated in the central hole *7a* of the friction ring 7.

The abrasive annulus 10 could be a disc, but the central hole may serve to assist the assembly of the device in practice. The abrasive element, whether annular or disc-like, could be an abrasive surface, or a coating, on the underface of the spool member 12, rather than a discrete element 10.

The sleeve 6, by means of which rubbing frictional contact is obtained on the flat running surface, need not be a discrete element secured on the body 1, but could be a friction-enhancing formation of the external cylindrical surface of the side wall 2 of the body 1.

It will be appreciated that the functions of the friction ring 7 and the abrasive annulus 10 may be reversed axially with respect to the body 1 and spool member 12. For example, the friction annulus 7 could be disposed in contact with the underface of the spool member, and the abrasive annulus secured, or at least drivingly engaged, in the lower part of the body 1, the cutter head 8 being then positioned between the two in inverted position. Relative rotaton between the cutter edges 9 and the abrasive annulus 10 would still be obtained, but in this instance the cutter head 8 would remain stationary, and the abrasive annulus 10 would rotate with respect to the cutter head.

Figure 2:
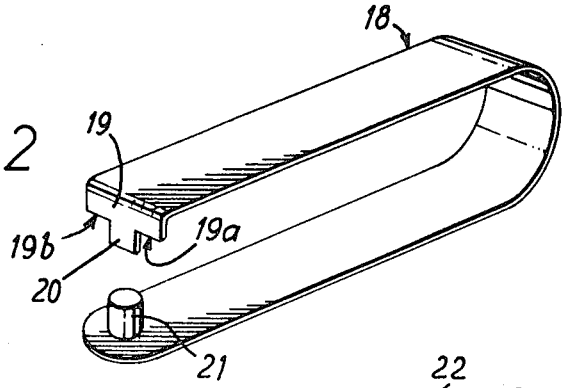
FIG. 2 is a perspective elevation of a first form of holder for the device.
Figure 3:
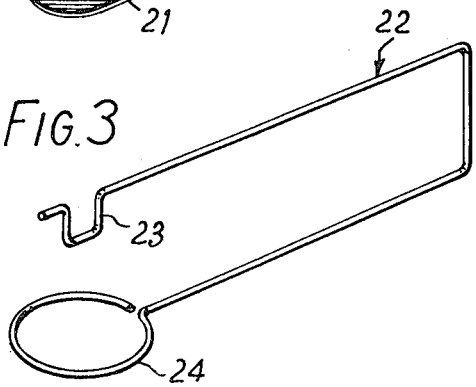
FIG. 3 is a perspective elevation of a second form of holder for the device.

Referring now to FIGS. 2 and 3 of the drawings, there are shown two forms of holder which may be used instead of grasping the device directly between finger and thumb.

In FIG. 2, the holder consists of a strip of springy metal or plastics material 18 having a bent-over end 19 with a central lug 20 of less width. The lug 20 is adapted to enter the central opening of the flange 15, and the edges 19*a*, 19*b* are adapted to enter into engagement with the radial ribs 17, or alternatively into diametrically opposed radial slots (not shown) included in the rib formation 17. Again, the ribs 17 could be omitted and replaced by a single diametral slot, or one or more pairs of radial slots (not shown) to receive the edges 19*a*, 19*b*, all for the purpose of preventing relative rotation between the flange 15 and the holder end 19.

The other arm of the holder has a cylindrical lug 21 which is adapted to engage into the opening 4 of the other end of the device, for free relative rolling movement of the device with respect to the holder.

In FIG. 3, the holder consists of a member of springy wire or plastics material 22 having adjacent the end of one of its arms a U-shaped portion 23 which is adapted to engage into a diametral slot (not shown) provided in the flange 15, for the purpose of preventing relative rotation between the flange 15 and the holder. The other arm of the member 22 is formed as a loop 24 adapted to engage, with slight clearance, about the greatest diameter of the frusto-conical portion of the end wall 3 of the device, thereby to act as a journal for that end.

In both of the forms of holder, it would be preferable to have the arms so shaped that the inherent resilience of the holder would hold its end in engagement with the device, but permitting springing apart when necessary to remove the device. With both forms of holder, the act of grasping it in the hand would reinforce the inward movement of the arms towards the device. The use of the holder facilitates running of the device along a surface.

I claim:

1. A device, for honing a shaver rotary cutter head having axially-faced cutting edges, comprising first and second members one of which is rotatable within the other about an axis, one of said members having at a first exposed axial end abutment means which are at least partially radially spaced from said axis for providing non-rotatable engagement with a first of two digits of a user holding the device between those two digits, the other of said members having at a second exposed axial end remote from said first end a coaxial means for engagement by the other of said digits and providing a journal for relative rotation of said other member about said axis relative to said other digit, rotation-preventing means to act between one of said members and a rotary cutter head disposed when the device is in use coaxially intermediate said respective exposed axial ends for preventing relative rotation of said cutter head with respect to said one member, and an abrasive face on the other of said members for contacting the axially-facing cutting edges of said cutter head, said other member having an external circumferential friction-enhancing surface for engagement with a running surface.

2. A device, as claimed in claim 1, wherein the tubular member has one end open and the other end at least partially closed by an end wall provided with said formation adapted to journal the member on the other digit of the user.

3. A device, as claimed in claim 1, wherein an abrasive element is positioned against said other member for contacting the axially-facing cutting edges of the cutter head.

4. A device, as claimed in claim 1, wherein said other member carries an external circumferential sleeve, said sleeve providing said external circumferential friction-enhancing surface adapted for frictional engagement with a running surface.

5. A device, for honing a shaver rotary cutter head having axially-facing cutting edges, comprising:

(i) a first member which is tubular;

(ii) a second member positioned in said first member and journalled therein for relative rotation about an axis, said tubular member having one end open and the other end at least partially closed by an end wall having at its axially exposed face a frusto-conical axial recess coaxial with said axis and bounded by a smooth surface, said recess being adapted to receive the tip of a digit of the user such that said first member is journalled on said digit, said second member having at the opposite axial exposed end a frusto-conical axial recess bounded by a surface having angularly spaced radial ribs adapted to engage the tip of a second digit of the user to prevent rotation of said second member relative to said second digit;

(iii) a ring of elastomeric material disposed within said first member and seated against said end wall;

(iv) an annulus of abrasive material secured coaxially on said second member remote from said axial recess, such that a rotary cutter head may be positioned between said elastomeric ring and said abrasive annulus;

(v) a sleeve of elastomeric material secured coaxially about said first member and having its external circumferential surface adapted for frictional engagement with a running surface.

6. A device, for honing a shaver rotary cutter head having axially-facing cutting edges, comprising first and second members journalled one with respect to the other for relative rotation about an axis, one of said members having at a first exposed axial end an axial recess coaxial with said axis and bounded by a surface having angularly spaced projections for non-rotatable engagement by a first digit of the user holding the device between two opposed digits, the other of said members having at a second exposed axial end remote from said first end means such as a formation adapted to journal said other member by engagement with the other of said digits for rotation substantially about said axis, means to act between one of said members and a rotary cutter head disposed when the device is in use coaxially intermediate said respective exposed axial ends for preventing relative rotation of said cutter head with respect to said one member, and an abrasive face on the other of said members for contacting the axially-facing cutting edges of said cutter head, said other member having an external circumferential surface adapted for frictional engagement with a running surface.

7. A device, for honing a shaver rotary cutter head having axially-facing cutting edges, comprising first and second members journalled one with respect to the other for relative rotation about an axis, one of said members having at a first exposed axial end abutment means which are spaced radially from said axis for providing non-rotational engagement with a first of two digits of a user holding the device between those two digits, the other of said members having at a second exposed axial end remote from said first end a coaxial means for engagement by the other of said digits and providing a journal for relative rotation of said other member about said axis relative to said other digit, an element of elastomeric material disposed when the device is in use coaxially intermediate said respective exposed axial ends and adapted to bear frictionally on said cutter head for preventing relative rotation of said cutter head with respect to said one member, and an abrasive face on the other of said members for contacting the axially-facing cutting edges of said cutter head, said other member having an external circumferential friction-enhancing surface for engagement with a running surface.

8. A device, as claimed in claim 7, wherein said elastomeric element is a ring seated loosely in said one member.

9. A device for honing a shaver rotary cutter head having axially-facing cutting edges, comprising first and second members one of which is tubular and the other of which is rotatable within said one member about an axis, one of said members having at a first exposed axial end abutment means which are spaced radially from said axis for providing non-rotatable engagement with a first portion of a holder, the other of said members having at a second exposed axial end remote from said first end a coaxial means to form with a second portion of said holder a journal for relative rotation of said other member about said axis, rotation-preventing means to act between one of said members and a rotary cutter head disposed when the device is in use coaxially intermediate said respective exposed axial ends for preventing relative rotation of said cutter head with respect to said one member, and an abrasive face on the other of said members for contacting the axially-facing cutting edges of said cutter head, said other member having an external circumferential friction-enhancing surface for engagement with a running surface.

10. A device, for honing a shaver rotary cutter head having axially-facing cutting edges, comprising first and second members one of which is tubular and the other of which is rotatable within said one member about an axis, said tubular member having one end open and the other end at least partially closed by an exposed axial end wall provided with an axial recess bounded by a smooth surface to receive a first digit of a user holding the device between two opposed digits and forming a journal thereon for said tubular member, the other of said members having at a second exposed axial end abutment means to engage the other digit of the user, rotation-preventing means to act between one of said members and a rotary cutter head disposed when the device is in use coaxially intermediate said respective exposed axial ends for preventing relative rotation of said cutter head with respect to said one member, and an abrasive face on the other of said members for contacting the axially-facing cutting edges of said cutter head, said tubular member having an external circumferential friction-enhancing surface for engagement with a running surface.

11. The method of sharpening the axially-facing cutting edges of a shaver rotary cutter which includes the steps of:

(i) disposing said rotary cutter in the device of claim 9 coaxially with respect to said first and second members and contacting said means for preventing relative rotation and with its cutting edges abutting said abrasive face;

(ii) engaging the device between the first and second portions of the holder, the first portion of said holder engaging said formation for non-rotatable engagement, the second portion of said holder engaging said formation for rotation;

(iii) placing said external circumferential surface in frictional engagement with a running surface, and (iv) moving the device, by means of the holder, along said running surface in at least one direction with said external circumferential surface maintained in frictional engagement with said running surface.

12. The method of sharpening the axially-facing cutting edges of a shaver rotary cutter which includes the steps of:

(i) disposing said rotary cutter in a device comprising first and second members journalled one with respect to the other for relative rotation about an axis, one of said members having at a first exposed axial end a formation adapted for non-rotatable engagement by a first digit of a user holding the device between two opposed digits, the other of said members having at a second exposed axial end face remote from said first end means such as a formation adapted to journal said other member by engagement with the other of said digits for rotation substantially about said axis, means to act between one of said members and the rotary cutter head disposed when the device is in use coaxially intermediate said respective exposed axial ends for preventing relative rotation of the cutter head with respect to said one member, and an abrasive face on the other of said members for contacting the axially-facing cutting edges of said cutter head, said other member having an external circumferential surface adapted for frictional engagement with a running surface, said rotary cutter being disposed coaxially with respect to said first and second members and contacting said means for preventing relative rotation and with its cutting edges abutting said abrasive face;

(ii) grasping the device between a first and second digit, the first digit engaging said formation for non-rotatable engagement, the second digit engaging said formation for rotation;

(iii) placing said external circumferential surface in frictional engagement with a running surface, and (iv) moving the device along said running surface in at least one direction with said external circumferential surface maintained in frictional engagement with said running surface.

* * * * *